United States Patent [19]

Ishii

[11] 4,286,258

[45] Aug. 25, 1981

[54] MOTOR ACTUATED BELL

[76] Inventor: Tadashi Ishii, c/o Kobishi Electric Co., Ltd. No. 4–6, Kaminakazato 3-Chome, Kita-Ku, Tokyo, Japan

[21] Appl. No.: 152,737

[22] Filed: May 23, 1980

[51] Int. Cl.[3] ..... G10K 1/064; G08B 3/10

[52] U.S. Cl. ..... 340/396; 340/399; 340/402

[58] Field of Search ..... 340/396, 399, 402; 116/152, 155

[56] References Cited

U.S. PATENT DOCUMENTS 4,183,018 1/1980 Sakaguchi ..... 340/396

*Primary Examiner*—Harold I. Pitts

*Attorney, Agent, or Firm*—Darby & Darby

[57] ABSTRACT

A motor actuated bell comprises an elongated resilient means for urging a hammer into striking contact with a gong. The hammer is secured to the central portion of the resilient means. A cam means is connected to the motor drive shaft and acts on the hammer to intermittently urge the same away from the gong against the bias of the resilient means.

8 Claims, 6 Drawing Figures

MOTOR ACTUATED BELL

BACKGROUND OF THE INVENTION

1. Field of the Invention

This invention relates generally to motor actuated bells and more particularly to motor actuated bells of the type in which a motor drives a hammer through a transmission means to strike against an associated gong with substantial impact to thereby produce bell sound of great volume.

2. Prior Art

One conventional motor actuated bell, as shown in FIG. 6, comprises a small DC motor 100 having a drive shaft 101 on which a gear 102 is fixedly mounted, a wheel gear 103 fixedly mounted on a shaft 104 and engaging the gear 102, and a cam 105 mounted on the shaft 104. With this construction, the motor 100 is driven to rotate the cam 105 through the meshed gears 102, 103 so that the cam intermittently acts on the end of a hammer 106 to allow the same to strike against an associated gong against the bias of a coil spring 107 to produce bell sound. This known motor driven bell has been found not entirely satisfactory in that the motor need to provide a substantial torque to enable the hammer to strike against the gong with substantial impact to produce bell sound of great volume.

SUMMARY OF THE INVENTION

It is therefore an object of this invention to provide a motor actuated bell of the type which is capable of producing bell sound of substantial volume without the need for a great motor torque.

According to the present invention there is provided a motor actuated bell which comprises a base; a motor mounted on the base and having a rotatable drive shaft; a gong mounted on the base; a hammer for striking against the gong; an elongated resilient means for urging the hammer into striking contact with the gong, the resilient means mounted on the base, and the hammer being supported on the central portion of the elongated resilient means; and a cam means connected to the motor drive shaft and acting on the hammer to intermittently urge the same away from the gong against the bias of the resilient means.

Other advantages, features and additional objects of the present invention will become manifest to those versed in the art upon making reference to the detailed description and the accompanying sheets of drawings in which preferred embodiments incorporating the principles of the present invention are shown by way of illustrative examples.

DESCRIPTION OF THE PREFERRED EMBODIMENTS

Figure 1:
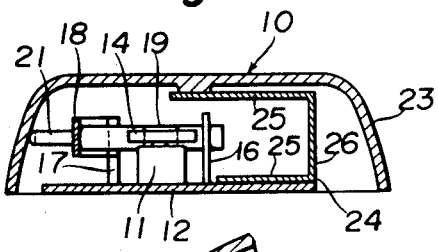
FIG. 1 is a cross-sectional view of a motor actuated bell according to a first embodiment of this invention.
Figure 2:
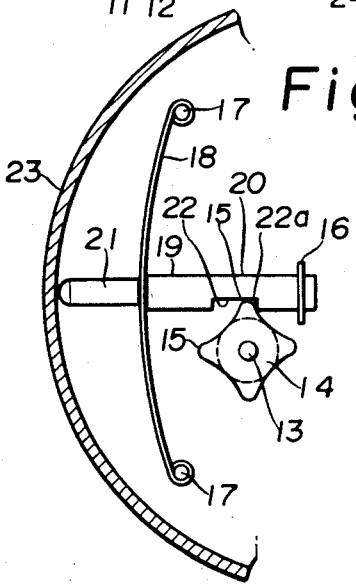
FIG. 2 is a schematic plan view of the bell with a gong broke away.

FIGS. 1 and 2 show a motor actuated bell 10 according to a first embodiment of this invention.

An electric motor 11 is fixedly mounted on a mounting plate or base 12 by suitable fastening means such as screws, the motor having a drive shaft 13 extending from the motor body perpendicular to the mounting plate 12. A cam member 14 of generally square shape is fixedly mounted at its center on the motor drive shaft 13 for rotation therewith about the drive shaft, the cam member being disposed in a plane parallel to the mounting plate 12. The cam member 14 has four cam surfaces 15 at its four corners.

A stamped-out portion 16 of the mounting plate 12 extends perpendicular to the plane thereof to provide a mounting portion, the mounting portion having an opening formed therethrough. A pair of spaced posts 17, 17 are fixedly secured to and extend perpendicularly from the mounting plate 12. An arcuate leaf spring 18 extends between and are secured at its opposite ends to the pair of spaced posts 17, 17, the leaf spring being disposed in parallel spaced relationship to the mounting plate 12.

A hammer member 19 of cylindrical shape has a base portion 20 and a head portion 21 of a smaller diameter extending from the base portion, the base portion having a notch 22 formed in its peripheral surface intermediate its opposite ends. The head portion 21 extends through the leaf spring 18 centrally of the length thereof and is fixedly secured thereto immediately adjacent to the base portion 20. The base portion is slidably received in the opening of the mounting portion 16. The cam surfaces 15 of the cam member 14 are engageable with the notch 22 to move the hammer member 19 in a right-hand direction (FIG. 2). The hammer member is disposed generally perpendicular to the leaf spring 18 and is movable along the length thereof in parallel spaced relation to the mounting plate 12.

The mounting plate 12 is arranged within an inverted cup-shaped gong 23. A connecting member 24 of a channel-shaped cross-section has a pair of opposed arms 25, 25 and a base 26 interconnecting the arms. The arms are fixedly secured respectively to the gong 23 and the mounting plate 12 by suitable fastening means such as screws.

The arcuate leaf spring 18 normally holds the hammer head 21 against the inner wall of the gong 23 as shown in FIG. 2. The stroke of the hammer member 19 is so determined that the arcuate leaf spring 18 is prevented from being completely overturned or inverted at the end of the hammer retracting stroke. With this arrangement, a restoring force is exerted on the leaf spring 18 when it is urged away from the gong 23.

In operation, the motor 11 is first driven through a power source (not shown) to rotate the cam member 14 in a clockwise direction so that one of the cam surfaces 15 engages the edge **22*a* of the notch 22 to retract or move the hammer member 19 in a right-hand direction against the bias of the leaf spring 18. In this condition, the hammer head 21 is moved away from the gong 23, and the leaf spring 18 is deformed. The cam member 14 continues to rotate to bring the cam surface 15 out of engagement with the notch 22 whereupon the hammer member 19 is moved toward the gong 23 under the action of the leaf spring 18 to allow the hammer head 21 to strike the gong to produce bell sound of the required volume. The cam member 14 continues to rotate in a clockwise direction to bring the next cam surface 15 into engagement with the edge 22***a* of the notch 22 so that the hammer head 21 strikes the gong 23 as described above. Thus, the four cam surfaces 15 are brought into engagement with the edge 22*a* of the notch 22 in succession to actuate the hammer member 19 intermittently.

The cam member 19 having the four cam surfaces 15 may be replaced by a cam member having one or more cam surfaces.

Figure 3:
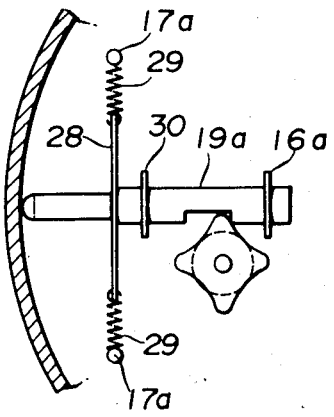
FIG. 3 is a view similar of FIG. 2 but showing a second embodiment of the invention.

FIG. 3 shows a second embodiment of the invention in which some of the component parts are omitted for illustration purposes. A motor actuated bell in this embodiment differs from the bell 10 in the preceding embodiment of the invention only in that the arcuate leaf spring 18 is replaced by a combined construction of leaf spring 28 and coil springs 29, 29 and in that another stamped-out mounting portion 30 is provided. The hammer member 19*a* is disposed perpendicular to the leaf spring 28.

The straight leaf spring 28 has a pair of apertures formed therethrough at its opposite ends. Each of the coil springs 29, 29 has one end connected to the post 17*a* and the other end engaged in the aperture of the leaf spring 28.

The operation is carried out as described above for the bell 10 in the preceding embodiment of the invention.

Figure 4:
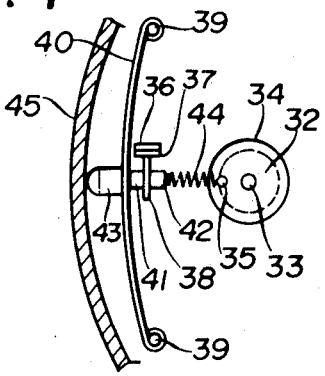
FIG. 4 is a view similar to FIG. 2 but showing a third embodiment of the invention.

FIG. 4 shows a third embodiment of the invention in which some of the component parts are omitted for illustration purposes.

An electric motor 32 is mounted on a mounting plate, the motor having a drive shaft 33 disposed perpendicular to the mounting plate. A cam disc 34 is fixedly secured at its center to the drive shaft 33 for rotation therewith about the drive shaft and disposed in a plane parallel to the mounting plate. The disc 34 has a cam pin 35 disposed in eccentric relationship to the drive shaft 33.

A stamped-out portion 36 of the mounting plate extends perpendicular to the plane of the mounting plate. A bracket 37 of T-shaped cross-section is fixedly secured to the mounting portion at its base, the bracket having an opening formed through its leg portion 38.

A pair of spaced posts 39, 39 extend perpendicularly from the mounting portion. An arcuate leaf spring 40 extends between and are secured at its opposite ends to the pair of posts 39, 39, the leaf spring being disposed in parallel spaced relationship to the mounting plate.

A hammer member 41 of a cylindrical configuration has a base portion 42 and a head portion 43 of a greater diameter extending from the base portion. The base portion is slidably received in the opening of the bracket 37. The base portion extend through the leaf spring 40 centrally of the length thereof and is fixedly secured thereto immediately adjacent to the head portion 43. The hammer member 41 is disposed generally perpendicular to the leaf spring 40.

A coil spring 44 has one end thereof connected to the free end of the base portion 42 and the other end to the eccentric cam pin 35. The coil spring 44 is greater in spring constant than the leaf spring 40.

The above-mentioned bell actuating mechanism is mounted within a gong 45, as described above for the bell 10 in the first embodiment of the invention. The arcuate spring 40 normally holds the hammer head 43 against the inner wall of the gong 45 as shown in FIG. 4. The stroke of the hammer member 41 is so determined that the arcuate leaf spring 40 is prevented from being completely inverted at the end of the hammer retracting stroke.

In operation, the motor 32 is first driven to rotate the cam disc 34 in a clockwise rotation so that the hammer member 41 is retracted or moved away from the wall of the gong 45 against the bias of the leaf spring 40 through the intermediary of the cam pin 35 and the coil spring 44, with the leaf spring being deformed. The cam disc 34 continues to be rotated to allow the hammer member 41 to reach the end of its retracting stroke whereupon the hammer head 43 is brought into striking contact with the gong 45 under the action of the leaf spring 40 to produce bell sound. This cycle of operation is continuously repeated.

Figure 5:
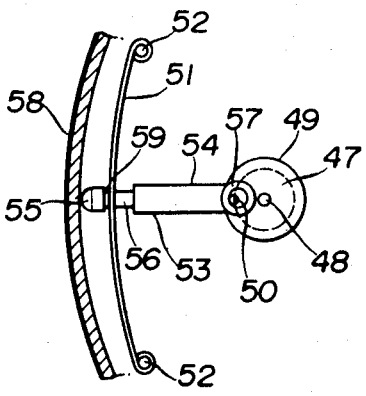
FIG. 5 is a view similar to FIG. 2 but showing a fourth embodiment of the invention.
Figure 6:
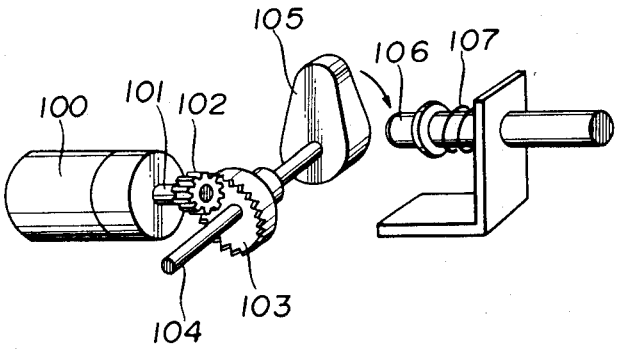
Fig. 6 (Prior Art)
FIG. 6 is a schematic perspective view of a motor actuated bell provided in accordance with the prior art.

FIG. 5 shows a fourth embodiment of the invention in which some of the component parts are omitted for illustration purposes.

An electric motor 47 is mounted on a mounting plate, the motor having a drive shaft 48 disposed perpendicular to the mounting plate. A cam disc 49 is fixedly mounted on the drive shaft 48 at its center for rotation therewith about the drive shaft. The disc 49 has a cam pin 50 disposed in eccentric relationship to the drive shaft 48.

An arcuate leaf spring 51 extends between and is connected at its opposite ends to a pair of spaced posts 52, 52 extending perpendicularly from the mounting plate, the leaf spring being disposed in parallel spaced relation to the mounting plate. The leaf spring 51 has an opening formed therethrough centrally of the length thereof.

A hammer member 53 of a cylindrical shape has a base portion 54, a head portion 55 and a retainer portion 56 of a smaller diameter extending therebetween, the hammer member 53 having an annular portion 57 formed integrally with the base portion 54. The retainer portion 56 is slidably received in the opening of the leaf spring 51 while the eccentric cam pin 50 is loosely fitted in the annular portion 57. The hammer member 53 is disposed generally perpendicular to the leaf spring.

The above-mentioned bell actuating mechanism is mounted within a gong 58. The stroke of the hammer member 53 is so determined that the arcuate leaf spring 51 is prevented from being completely inverted at the end of the hammer retracting stroke.

When the hammer 53 is in its inoperative position, with the hammer head 55 held against the wall of the gong 58, the edge 59 of the hammer head 55 is spaced slightly from the leaf spring 51, as shown in FIG. 5.

In operation, the motor 47 is first driven to rotate the cam disc 49 in a clockwise direction so that the hammer member 53 is retracted or moved away from the wall of the gong 58 against the bias of the leaf spring 51, with the edge 59 of the hammer head 55 first engaging the leaf spring 51. The cam disc 49 continues to be rotated to allow the hammer member 53 to reach the end of its retracting stroke whereupon the hammer head 55 is brought into striking contact with the wall of the gong 58 under the action of the leaf spring 51 to produce bell sound. This cycle of operation is continuously repeated. When the hammer head 55 strikes against the wall of the gong 58, the hammer member 53 rebounds from the gong wall.

As described in the above embodiments of the invention, the hammer is supported on the center of the leaf spring, and the leaf spring imparts sufficient momentum to the hammer to allow the same to strike against the gong with substantial impact so that the bell sound of great volume can be produced.

While the motor actuated bells according to this invention have been specifically shown and described herein, the invention itself is not to be restricted by the exact showing of the drawings or the description thereof. For example, the hammer may be normally disposed out of contact with the gong when the leaf spring is in its inoperative position. Further, a speed reducer may be connected to the motor drive shaft to actuate the hammer at a lower speed.

What is claimed is:

1. A motor actuated bell which comprises:

(a) a base;

(b) a motor mounted on said base and having a rotatable drive shaft;

(c) a gong mounted on said base;

(d) a hammer for striking against said gong;

(f) an elongated resilient means for urging said hammer into striking contact with said gong, said resilient means mounted on said base, and said hammer being supported on the central portion of said elongated resilient means; and (g) a cam means connected to the motor drive shaft and acting on said hammer to intermittently urge the same away from said gong against the bias of said resilient means.

2. A bell according to claim 1, in which said elongated resilient means comprises a leaf spring, said hammer comprising an elongated member, said elongated member being supported on said leaf spring intermediate its opposite ends, and said elongated hammer member being disposed generally perpendicular to said leaf spring and being movable along the length thereof.

3. A bell according to claim 2, in which said elongated hammer member has a notch engageable by said cam means.

4. A bell according to claim 3, in which said cam means comprises a cam member fixedly secured at its center to the motor drive shaft for rotation therewith about the shaft, said cam member having its periphery a plurality of cam surfaces engageable with said notch.

5. A bell according to claim 2, in which said leaf spring has an arcuate shape, said leaf spring being prevented from being completely inverted when said cam means acts on said hammer.

6. A bell according to claim 2, in which said leaf spring has a pair of coil springs connected thereto at its opposite ends, respectively.

7. A bell according to claim 2, in which said elongated hammer member has an opening at its one end, said cam means compring a disc fixedly mounted at its center on the motor drive shaft for rotation therwith about the shaft, and said disc having a cam pin disposed in eccentric relationship to the drive shaft and loosely fitted in said opening.

8. A bell according to claim 2, in which said cam means comprises a disc fixedly mounted at its center on the motor drive shaft for rotation therewith about the shaft, said disc having a cam pin disposed in eccentric relationship to the drive shaft, and a coil spring acting between one end of said elongated hammer emmber and said cam pin.

* * * * *